US005383726A

United States Patent [19]

Lanaro

[11] Patent Number: 5,383,726

[45] Date of Patent: Jan. 24, 1995

[54] DEVICE FOR THE PREPARATION OF MIXTURES, FOR EXAMPLE THE PREPARATION OF DYE SOLUTIONS IN TEXTILE PLANTS

[75] Inventor: Walter Lanaro, Ponzone di Trivero, Italy

[73] Assignee: Lawer S.r.l., Lessona, Italy

[21] Appl. No.: 154,208

[22] Filed: Nov. 17, 1993

[30] Foreign Application Priority Data

Nov. 27, 1992 [IT] Italy ..... TO92A000960

[51] Int. Cl.[6] ..... B01F 5/04; B01F 7/16

[52] U.S. Cl. ..... 366/168; 366/184; 366/286

[58] Field of Search ..... 366/285, 286, 279, 292, 366/297, 150, 164, 167, 168, 169, 171, 172, 173, 177, 155, 184

[56] References Cited

U.S. PATENT DOCUMENTS

| | | | |
|---|---|---|---|
| 2,324,179 | 7/1943 | Srob . | |
| 2,967,433 | 1/1961 | Phillips | 366/285 |
| 3,156,452 | 11/1964 | Touzalin et al. . | |
| 3,356,350 | 12/1967 | Burr et al. . | |
| 4,095,287 | 6/1978 | Felser et al. . | |
| 4,647,213 | 3/1987 | Hay | 366/286 |
| 5,044,762 | 9/1991 | Blakley | 366/286 |

FOREIGN PATENT DOCUMENTS

| | | |
|---|---|---|
| 70533/87 | 9/1987 | Australia . |
| 0013882 | 8/1980 | European Pat. Off. . |
| 597966 | 12/1925 | France . |
| 1215038 | 4/1960 | France . |
| 1507155 | 12/1967 | France . |
| 2245302 | 3/1974 | Germany . |
| 1-150508 | 6/1989 | Japan . |
| 1128658 | 10/1968 | United Kingdom . |
| WO87/04642 | 8/1987 | WIPO . |

*Primary Examiner*—Robert W. Jenkins
*Attorney, Agent, or Firm*—Barnes & Thornburg

[57] ABSTRACT

The device enables a first component such as a mixture of powdered dyes to be dissolved intimately in a liquid solvent. To a slide movable vertically are attached a duct for making the liquid solvent flow into a basin in which the powdered mixture is located and a plurality of rotary whisks or helical agitator members able to dip into the solution so as to cause the intimate mixing thereof due to their rotation. The movable slide also carries a protective hood which surrounds the agitator members and the duct. After the solution has been taken from the basin by suction through the said duct it is possible to wash the basin and all the parts of the device which have come into contact with the solution in order to avoid contamination of a mixture intended to be prepared subsequently in the device.

14 Claims, 3 Drawing Sheets

DEVICE FOR THE PREPARATION OF MIXTURES, FOR EXAMPLE THE PREPARATION OF DYE SOLUTIONS IN TEXTILE PLANTS

DESCRIPTION

The present invention relates to a device for the preparation of mixtures and has been developed with particular concern for its possible use in the preparation of dye solutions in textile plants.

The preparation of such solutions, normally carried out in so-called "dye houses" ("colour kitchens") in textile plants, usually requires the use of basins into which a certain quantity of the powdered dye is introduced. For this purpose the powders corresponding to the "recipe" which determines the colour which it is intended to obtain are poured into the basin—usually placed on a balance. A liquid, usually water or an aqueous solution for dissolving the powdered dyes, is then introduced into the basin to form a dye solution for dyeing the yarns and textiles.

In carrying out this function it is necessary to take account of various requirements and to solve various operational problems.

In the first place it is necessary to ensure that the powdered dyes are dissolved effectively in the solution without any granules or like solids remaining: the powdered dyes are often strongly hygroscopic and thus tend to lump together in the storage containers.

Usually the powdered dyes are however also volatile; it is thus necessary to prevent the powders from dispersing into the environment and polluting it during the preparation of the solution.

Yet again it is necessary to ensure that all the instruments used for the preparation of a solution can be cleaned and washed once the operation is finished: this is to avoid any residues from one preparation being able to pollute a subsequent preparation and modifying its colour characteristics.

There is thus a marked tendency in "dye houses" in textile plants to automate all the operations inherent in the storage of the powdered dyes, their collection and metering in accordance with the predetermined recipe, the preparation of the solutions and their forwarding to the subsequent use in a cycle which is automated as far as possible, even as regards the use of automated equipment such as robots, etc.

The object of the present invention is to provide a device which is able to satisfy all the requirements expressed above in an ideal manner.

The invention may best be understood by referring to the following descripiton and accompanying drawings which illustrate the invention. In the drawings.

According to the present invention, this object is achieved by virtue of a device having the characteristics claimed specifically in the claims which follow.

Figure 1:
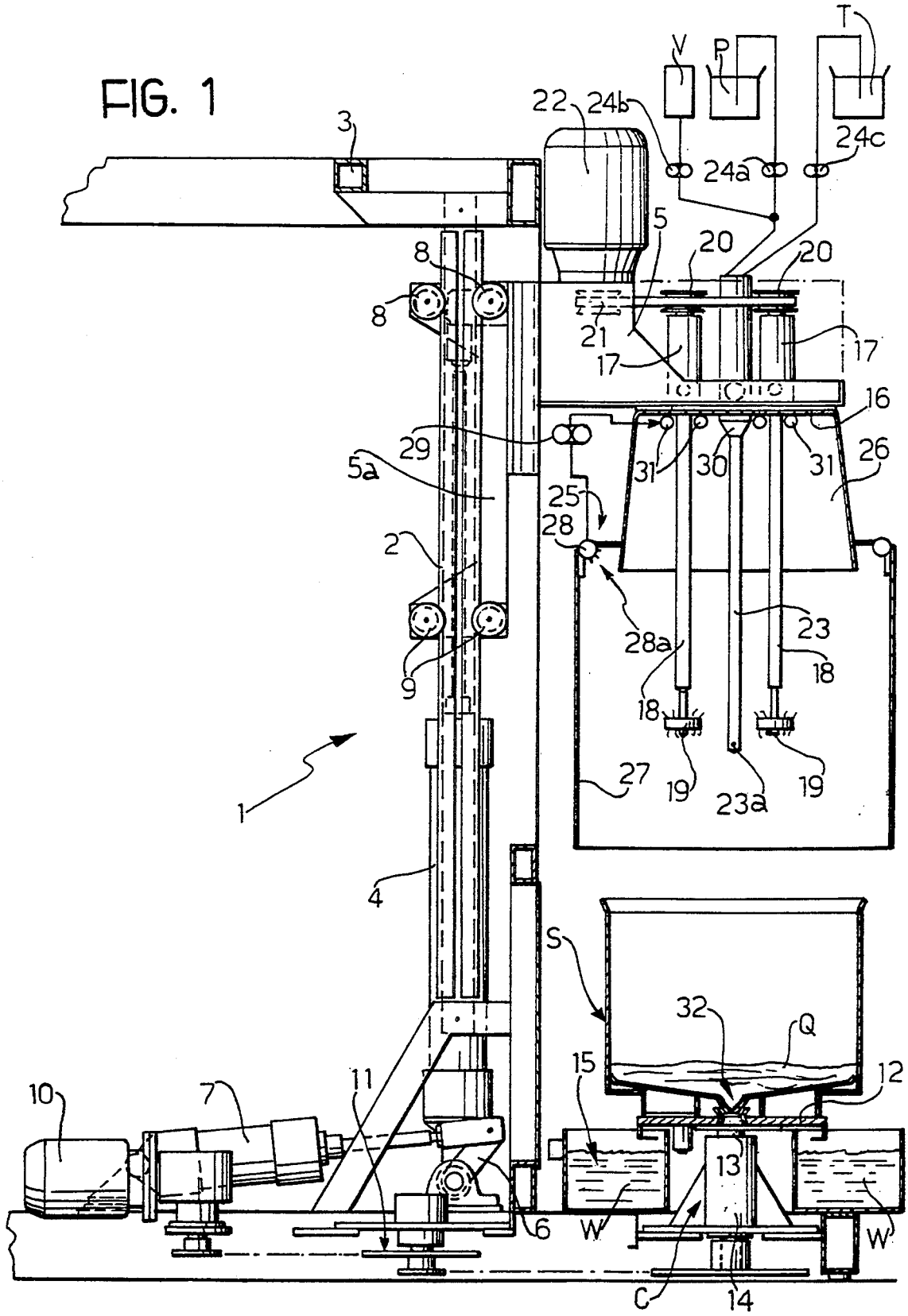
FIG. 1 illustrates a side elevational view of a system constructed according to the invention in a first state of operation.
Figure 2:
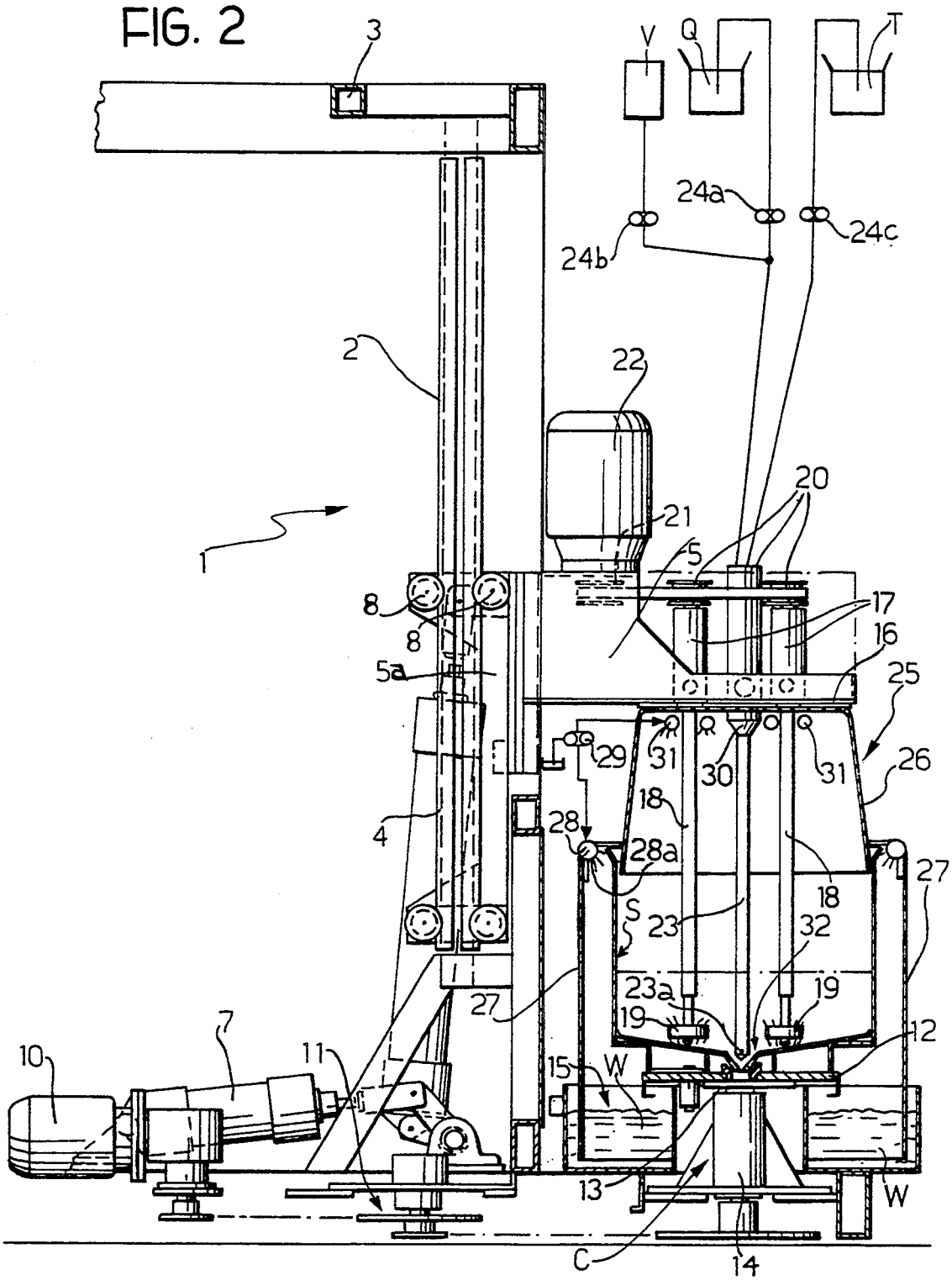
FIG. 2 illustrates a side elevational view of a system according to the invention in a second state of operation; and, FIG. 3 illustrates a side elevational view of a system according to the invention in a third state of operation.
Figure 3:
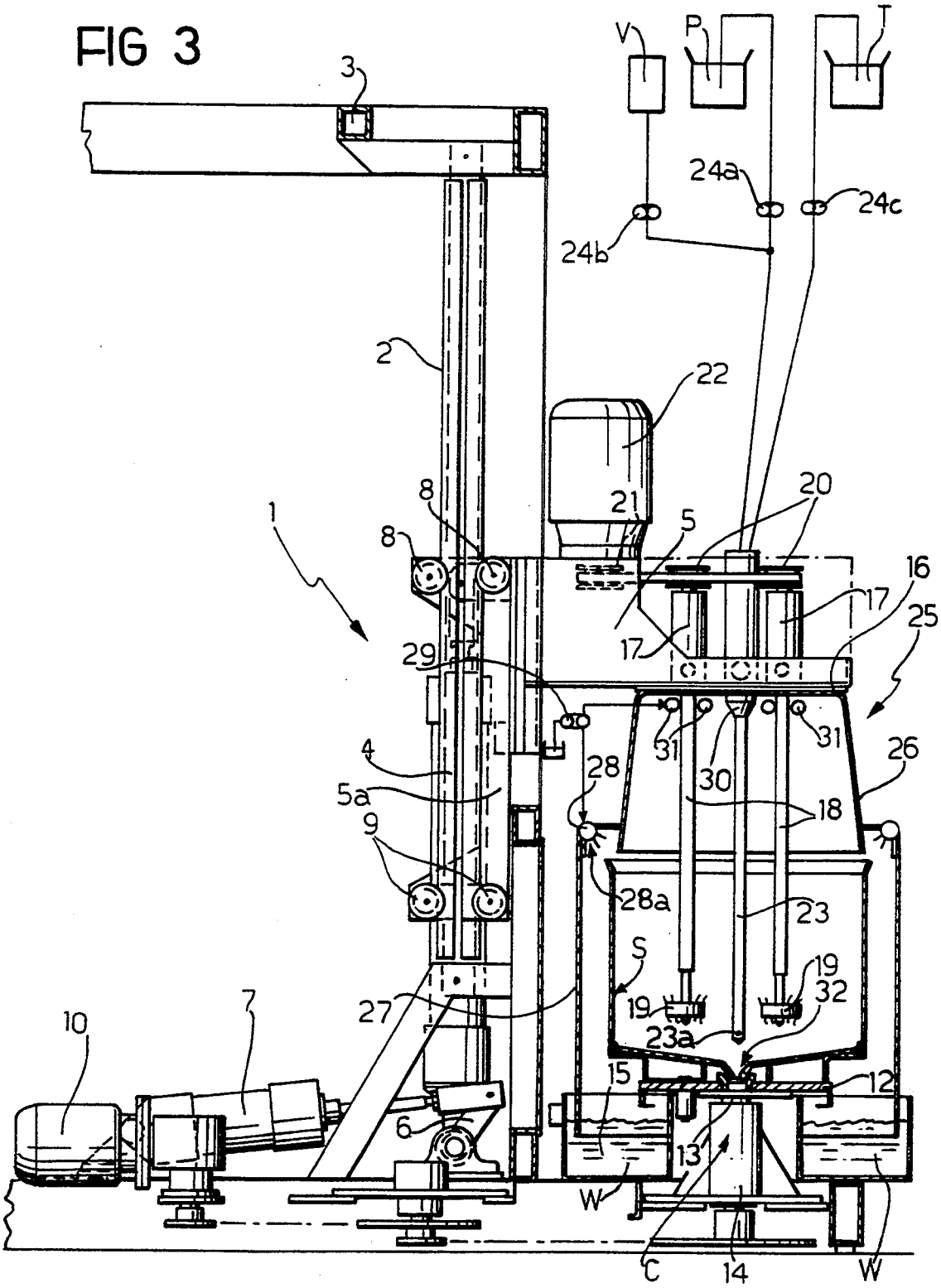

FIG. 1 illustrates a side elevational view of a system constructed according to the invention in a first state of operation;

FIG. 2 illustrates a side elevational view of a system according to the invention in a second state of operation; and, FIG. 3 illustrates a side elevational view of a system according to the invention in a third state of operation.

As indicated above, the invention has been developed with particular concern for its possible use in dye houses in textile plants. Naturally, the reference to this field of use should not however be interpreted in any limiting sense in terms of the scope of the patent.

In this preferred field of application, the device according to the invention (generally indicated 1) is usually intended to be interposed between a station for the taking up and metering of the powdered dyes (not illustrated in the drawings) and a station for their use (also not illustrated explicitly) in which the dye solutions obtained by dissolving the powders in a mass of solvent (usually an aqueous solution) are used for a dyeing process.

The take-up and metering station supplies, on an output conveyor generally indicated C, basins S or like containers into which a certain quantity of the powdered dyes Q has already been metered in accordance with a given recipe.

The criteria for the realisation of the take-up and metering station for the powdered dyes, as well as the criteria for the realisation of the downstream treatment stations are well known in the art and do not require description in detail here, particularly since they are not in themselves relevant for the purposes of an understanding of the invention. With regard to the realisation of the units for the storage, automatic taking up and metering of the powdered dyes, reference may usefully be made to various prior patents in the name of the same applicant such as, for example, Italian patents Nos. 1,211,260, 1,211,592, 1,211,599, 1,218,689, as well to italian patent applications Nos. 67925-A/90, TO91A000002, TO91A000271 and TO91A000703.

The function of the device 1 according to the invention is essentially that of receiving the basins S on the conveyor C, then providing for the formation of the solutions by the dissolution of the powdered dyes Q in a mass of liquid solvent with intimate and homogeneous mixing of the solution obtained, and subsequent supply of the dye solution thus obtained to a station of use, with washing of the basin S used for the preparation of the dye solution and of parts of the device which have come into contact with the solution itself in order to enable their reuse. The process of metering and mixing of the liquids and powders in thus carried out entirely in the basin itself, thereby avoiding a transfer operation irrespective of whether metering is carried out manually or by means of automated apparatus used for this purpose.

In the embodiment currently preferred, the device 1 is composed essentially of a bracket structure comprising a column 2 constituted by two rails arranged side-by-side and held substantially vertically by a supporting framework 3 alongside the conveyor C. A slide 5 is slidable vertically on the rails under the action of a fluid-pressure actuator 4 and projects from the column 2 so as to overlie the conveyor C on which the basins S are located.

More precisely, (this detail is more clearly appreciable from an observation of FIGS. 2 and 3) the actuator 4 is connected by the free end of its shaft to the slide 5 and by the lower end of its body to a pivoted crank structure indicated 6 in turn driven by a further actuator 7. The function of the crank 6 is essentially that of moving the body of the actuator 4 slightly away from the column 2 (constituted, as stated, by two adjacent vertical rails between which the actuator 4 itself is interposed) such that the body of latter does not interfere with the downward sliding movement of the structure of the slide 5 when it is lowered towards the basin S as will be explained below. In fact, in order to keep the slide 5 exactly horizontal, it is mounted on a carriage 5*a* which cooperates with the rails of the column 2 through pairs of rollers, indicated 8 (upper rollers) and 9 (lower rollers) respectively, with the upper and lower rollers separated by a certain vertical spacing along the column 2.

Close to the actuator 7 (in the lower left hand part of the drawings) can also be seen a motor 10 which, through a transmission 11, for example a chain and/or gear transmission, drives a support disc 12 on which the basins S are mounted for rotation about a vertical axis.

In general the support disc 12 is mounted on a vertical shaft 13 inserted in a support 14 aligned with the central vertical axis of the basins S and surrounded by an annular tank 15. In operation of the device, the tank 15 is intended to contain a certain quantity of liquid W with its free surface surrounding the lower end of the peripheral wall of the basin S, at a certain distance therefrom. The function of the tank 15 and of the water (or liquid in general) contained therein will become clearer from the description which follows.

A structure which can to a certain extent be likened to the structure of anelectric mixer of the dipper type is mounted on the slide 5.

More specifically, a generally horizontal plate or platform 16 is mounted on the slide 5 and a plurality of shafts 18 (for example three, angularly spaced by 120° about the generally circular periphery of the plate 16) are rotatably supported in the plate 16, with the interposition of respective supports 17 fixed to the plate 16 itself, and project a certain distance beneath the plate 16.

The lower ends of the shafts 18 support respective helical members or whisks 19, this term being intended to indicate any element which, as a result of the rotation of the respective shaft 18 is able, when immersed in a liquid, to act as a stirrer, agitator or mixer.

The shafts 18 have keyed to their upper ends which project above the plate 16 respective pulleys 20 about which pass one or more belts (or like transmission elements such as chains) driven, for example, by a drive pulley 21 from a motor 22 whose actuation causes the rotation of the helical members or whisks 19.

Centrally with respect to the shafts 18, and hence with respect of the plate 16, a tubular duct 23 projects downwards from the bracket 7, usually through a distance slightly greater than the length of the shafts 18 and the whisks 19, and is connected to respective pump members 24*a*, 24*b* and 24*c*.

The pump members in question have the following functions:

- the pump member 24*a*: to pump cold water and/or hot water or another liquid taken from a first container or supply line P into the duct 23;
- the pump member 24*b*: to pump steam from a steam generator V into the duct 23;
- the pump member 24*c*: to draw the solution in the basin S through the duct 23 (according to criteria which will be clarified below) in order to transfer it to another station of use shown schematically in the form of a vessel T.

The complex formed by the shafts 18, the whisks 19 and the tubular duct 23 is surrounded by a hood or skirt structure generally indicated 25 and including:

- an upper part 26 of frusto-conical shape which diverges downwardly and surrounds the proximal or root portions of the shafts 18 and of the duct 23, over about half their length, and the lower edge of which can enter the mouth of the basin S, and
- a lower portion 27 of generally cylindrical shape, whose diameter is selected so as to allow the lowest edge of the part 27 to be immersed in the liquid W in the annular tank 15 when the hood structure 25 is lowered.

The vertical extent of the cylindrical part 27 is selected so that its said lower edge is located at a certain distance below the helical members or whisks 19 and the lower end of the tubular duct 23 which forms a nozzle 23*a*.

The helical members or whisks 19 and the nozzle 23*a* are intended to cooperate with the bottom portion of the basin S while, as already stated, the lower edge of the cylindrical skirt 27 is intended to be immersed in the annular tank 15.

The top edge of the cylindrical part 27 surrounds the bottom edge of the frusto-conical part 26 and has a tubular duct 28 provided with a ring of holes 28*a* opening into the cylindrical part 27.

By means of a pump member 29 (illustrated schematically in drawings) it is possible to pump water, or another pressurised liquid for washing the hood 25 and the members within it, into the duct 28 and into similar annular washing ducts indicated 30 and 31 which surround the root portions of the duct 23 and the shafts 18.

Preferably the bottom of the basin S is generally conical and upwardly open with a central part, indicated 32, forming a sort of sump in the centre of the bottom.

The operating sequence of the device according to the invention is driven by a general control member which can be constituted, for example, by an electronic processor or so-called PLC—all according to well known criteria in the art which do not need to be explained here.

In the initial condition, the basin S, containing a certain quantity of powdered dyes Q, advances on the conveyor c until it is located beneath the sliding bracket 5, aligned vertically with the members supported thereby, while the bracket 5 itself is held by the actuator 4 in the highest position of its sliding travel along the column 2. Subsequently the actuator 4 is driven so as to lower the slide 5 until it reaches the lowered position illustrated in FIG. 2.

In this position, the following conditions are achieved:

- the shafts 18 are lowered into the basin S, so that the helical members or whisks 19 provided at their lower ends are close to the conical base wall of the basin S;
- the tubular duct 23 is also lowered into the basin S so that its lower end, forming the nozzle 23*a*, extends into the sump 32 in the centre of the bottom wall of the basin S;
- the lower edge of the upper, frusto-conical part 26 of the hood structure 25 projects into the basin S so as to be located facing (from within) the mouth rim of the basin S; naturally, in order to obtain this result, the diameter of the lower edge of the wall 26 is selected so as to be slightly less than the diameter of the mouth of the basin S;

the lower edge of the cylindrical part 27 becomes immersed in the annular tank 15 and, as a result of the liquid W within it, forms a closed chamber around the basin S; and the washing duct 28 provided at the top of the cylindrical part 27 becomes located almost facing the mouth of the basin S, on the outside thereof.

Usually, during the lowering of the slide 5 (and at least during the final part of its descent), the motor 22 is actuated to rotate the whisks 19 so that these are better able to penetrate the powders Q in the bottom of the basin S.

The pump member 24a is then activated to pump the liquid intended to act as the solvent for the powdered dyes Q into the basin S through the tubular duct 23 and the nozzle 23*a*. After the time needed for the desired quantity of liquid solvent (typically hot water at 50° metered volumetrically with a liter-counter) to flow into the basin S, the PLC which controls the device stops the pump member 24*a* and activates the pump member 24*b* which makes steam from the generator V flow into the basin S through the duct 23 and the nozzle 23*a* so as to bring the bath (powders Q plus liquid) in the basin S to the desired dissolving temperature (checked by a probe).

Once the desired temperature has been reached, the pump member 24*b* is stopped and the motor 22 which drives the fast rotation of the shafts 18 and of the whisks 19 mounted at their ends is started. At the same time the motor 10 is also activated and rotates the basin S about its central vertical axis. This condition of operation is maintained for a predetermined time interval until an intimate, homogeneous solution of the powdered dyes Q in the liquid introduced into the basin S has been obtained. Once this result has been obtained, the motors 10 and 22 are stopped and the solution thus prepared is evacuated to the user T by the activation of the pump member 24*c* (which obviously operates in the opposite sense to that of the pump members 24*a* and 24*b*). The solution in the basin S is thus drawn through the duct 23 and pumped to the utilisation station (vessel T). Naturally the fact that the nozzle 23*a* extends into the sump 32 enables the action of evacuating the contents to be entirely effective: during the final phase of the evacuation of the basin S, the final residues of the solution in fact collect in the sump 32 from which they can be collected almost completely as a result of the suction through the nozzle 23*a*.

Once the solution has been completely evacuated, the device is ready for the washing of the basin and of the other parts involved in the preparation of the solution.

For this purpose, the pump member 29 is activated so as to pump pressurised hot water into the ducts 30 and 31 to wash the shafts 18, the whisks 19, the duct 23 and, indirectly, the inner surface of the basin S as well as, possibly, the outer surface of the basin S (through the duct 28). Simultaneously, the motors 10 and 22 are again activated. Once the washing phase is completed, the motors 10 and 22 are stopped and the water collected in the bottom of the basin S is evacuated by the reactivation of the pump member 24*c*. The washing phase may be repeated for several cycles, possibly with the replacement of the immission of hot water with the immission of steam taken from the generator V.

Subsequently, the slide 5 is raised slightly so as to move the helical members or whisks 19 and the nozzle 23*a* slightly away from the bottom of the basin S. As a result of this movement, the lower edge of the frustoconical part 26 is raised slightly from the mouth of the basin S. At this point, the activation of the pump member 30 enables washing water to flow through the duct 28 and to be sprayed particularly towards the mouth of the basin S. Again in this case, the water collects in the bottom of the basin S (in which the whisks 19 may be rinsed again by the lowering of the slide 5 and the reactivation of the motor 22) and is evacuated (to the user T or to a drain) by suction through the duct 23. A final jet of steam from the generator V usually completes the washing operation.

At this point, the device may return to the starting position illustrated in FIG. 1 with the slide 5 moved towards the top of the column 2 so as to allow, as a result of a movement of the conveyor C, the basin S to be removed and a new basin to be used for the preparation of a further dye solution to be supplied to the device 1 itself.

The whole operation is carried out in a completely automated cycle which avoids the dispersion of powders into the external environment and ensures that all the instruments used for the preparation of each solution are washed completely, avoiding contamination between solutions prepared subsequently. This is all thanks to the vessel 15 and its filling of water (usually with a continuous input and output through a vented tube) which enables the mixing system to be almost hermetically sealed without the use of seals. All this enables the metering (manual or automatic) and mixing of the liquids and powders to be carried out in the same basin S, thus avoiding any transfer operation.

What is claimed is:

1. A device for preparing mixtures from a product disposed in a container and a quantity of solvent introduced into the container, wherein said device includes:

a movable structure capable of performing a generally lowering and rising movement with respect to said container between a raised position and a lowered position;

at least one duct carried by said movable structure for directing said quantity of solvent into said container;

agitator means carried by said movable structure whereby, when said movable structure is in a loweredj position said agitator means are immersed in said container, said agitator means being adapted to be driven so as to effect intimate mixing of said product and said solvent, said at least one duct carrying associated suction pumping means whereby, when said movable structure is in said lowered position, actuation of said suction pumping means effects evacuation of said product mixed with said solvent from said container by suction through said at least one duct, said container having a bottom wall convergent towards a sump and said at least one duct having a lower nozzle which, when said movable structure is in said lowered position, extends into said sump.

2. A device as claimed in claim 1, wherein said agitator means comprise driven rotatable bodies in the form of helical members.

3. A device for preparing mixtures from a product disposed in a container and a quantity of solvent introduced into the container, wherein said device includes:

a movable structure capable of performing a generally lowering and rising movement with respect to said container between a raised position and a lowered position;

at least one duct carried by said movable structure for directing said quantity of solvent into said container;

agitator means carried by said movable structure whereby, when said movable structure is in a lowered position said agitator means are immersed in said container, said agitator means being adapted to be driven so as to effect intimate mixing of said product and said solvent, and drive means for driving the said container to rotate about a generally vertical axis.

4. A device for preparing mixtures from a product disposed in a container and a quantity of solvent introduced into the container, wherein said device includes:

a movable structure capable of performing a generally lowering and rising movement with respect to said container between a raised position and a lowered position;

at least one duct carried by said movable structure for directing said quantity of solvent into said container;

agitator means carried by said movable structure whereby, when said movable structure is in a lowered position said agitator means are immersed in said container, said agitator means being adapted to be driven so as to effect intimate mixing of said product and said solvent;

a vessel around said container for containing liquid in use; and a hood structure associated with said movable structure so as to extend around said agitator means and said at least one duct in an arrangement whereby, when said movable structure is in said lowered position in use, a bottom edge of said hood structure is immersed in said liquid in said container whereby said hood structure forms an enclosure around said container.

5. A device as claimed in claim 4, wherein said container defines an upwardly open mouth and said hood structure includes an upper part and a lower part, said upper part surrounding a proximal section of said agitator means and of said at least one duct and, when said movable structure is in said lowered position, facing said mouth of said container, and said lower part of said hood structure externally surrounding said container.

6. A device for preparing mixtures from a product disposed in a container and a quantity of solvent introduced into the container, wherein said device includes:

a movable structure capable of performing a generally lowering and rising movement with respect to said container between a raised position and a lowered position;

at least one duct carried by said movable structure for directing said quantity of solvent into said container;

agitator means carried by said movable structure whereby, when said movable structure is in a lowered position said agitator means are immersed in said container, said agitator means being adapted to be driven so as to effect intimate mixing of said product and said solvent, further ducts associated with said movable structure and respective pumping means associated with said further ducts for causing a washing fluids to flow towards said movable structure for washing said container and members associated with said movable structure.

7. A device as claimed in claim 6, wherein said further ducts include ducts for supplying a washing liquid to base parts of said agitator means.

8. A device as claimed in claim 6, wherein said further ducts include ducts for supplying a washing liquid to an upper part of said at least one duct.

9. A device as claimed in claim 5 or 6, wherein said further ducts include an annular washing duct located in the region between said upper part and said lower part of said hood structure for the purpose of spraying a washing liquid towards said mouth of said container.

10. A device for preparing mixtures from a product disposed in a container and a quantity of solvent introduced into the container, wherein said device includes:

a movable structure capable of performing a generally lowering and rising movement with respect to said container between a raised position and a lowered position;

at least one duct carried by said movable structure for directing said quantity of solvent into said container;

agitator means carried by said movable structure whereby, when said movable structure is in a lowered position said agitator means are immersed in said container, said agitator means being adapted to be driven so as to effect intimate mixing of said product and said solvent;

a column, said movable structure being mounted for sliding in a generally vertical direction on said column; and at least one fluid pressure actuator element connected to drive said movable structure to slide on said column.

11. A device as claimed in claim 10, wherein said fluid pressure actuator has an upper end connected to said movable structure and a lower end associated with the base of said column, and wherein an oscillating structure is interposed between said lower end of said fluid pressure actuator and said base of said column and is operable to cause said fluid pressure actuator to be spaced from said column during the lowering movement of said movable structure along said column for the purpose of preventing interference between said fluid pressure actuator and said movable structure.

12. A device as claimed in claim 11, wherein it includes to said column. a further fluid pressure actuator connected to control said oscillating structure.

13. A device as claimed in claim 12, wherein it includes rolling bodies interposed between said carriage and said column.

14. A device as claimed in claim 10, wherein it includes a carriage mounting said movable structure on said column for said sliding movement, said carriage having a predetermined vertical extent with respect

* * * * *